United States Patent [19]

Hummel et al.

[11] Patent Number: 4,567,823

[45] Date of Patent: Feb. 4, 1986

[54] ARRANGEMENT ON MULTI-COLOR ROTARY PRESSES FOR APPLICATION OF LIQUIDS TO A PRINTING UNIT CYLINDER

[75] Inventors: Peter Hummel, Offenbach am Main; Herbert Rebel, Rodgau, both of Fed. Rep. of Germany

[73] Assignee: M.A.N.-Roland Druckmaschinen Aktiengesellschaft, Fed. Rep. of Germany

[21] Appl. No.: 649,228

[22] Filed: Sep. 10, 1984

Related U.S. Application Data

[63] Continuation-in-part of Ser. No. 500,778, Jun. 3, 1983.

[30] Foreign Application Priority Data

Jun. 7, 1982 [DE] Fed. Rep. of Germany ..... 3221514

[51] Int. Cl.[4] ..... B41F 7/40; B41L 25/16

[52] U.S. Cl. ..... 101/148; 101/352; 118/258

[58] Field of Search ..... 101/350, 351, 352, 148, 101/247, 206–207, 140, 145, 136; 118/258

[56] References Cited

U.S. PATENT DOCUMENTS

| | | | |
|---|---|---|---|
| 2,283,003 | 5/1942 | Frostad et al. | 101/182 |
| 3,283,707 | 11/1966 | Greubel et al. | 101/148 |
| 3,433,155 | 3/1969 | Norton | 101/148 |
| 3,508,489 | 4/1970 | Norton | 101/148 |
| 3,673,959 | 7/1972 | Jezuit et al. | 101/148 |
| 3,688,694 | 9/1972 | Preuss et al. | 101/148 |
| 3,749,011 | 7/1973 | Abendroth et al. | 101/148 |
| 3,757,689 | 9/1973 | Koch et al. | 101/352 |
| 3,842,735 | 10/1974 | Southam et al. | 101/145 |
| 3,991,674 | 11/1976 | Petri | 101/148 |

*Primary Examiner*—J. Reed Fisher

*Attorney, Agent, or Firm*—Leydig, Voit & Mayer, Ltd.

[57] ABSTRACT

The dampening unit of a rotary printing press is provided with additional transmission components and a swiveling stop mechanism so that the dampening unit can also apply a varnish having an arbitrary viscosity. For applying dampening solution to the plate cylinder (5) of the rotary press, the dampening unit has a fountain roller (13) feeding a transfer roller (15) and an applicator roller (16) which are driven by the press drive. When the dampening unit is used as a varnishing unit, clutches (28, 29) are enabled and disabled so that the transfer roller (15) is driven by a separate drive (17) which rotates the fountain roller (13). The applicator roller (16) is selectively thrown off by pneumatic actuators (32, 35) in such a way that all rollers (14–16) of the dampening unit are connected to each other and can be driven by the separate drive (17). A third position is also defined wherein the applicator roller (16) is also selectively thrown off 5/10 mm from the transfer roller (15). When the applicator roller (16) is thrown off the plate cylinder (11), the fountain roller (16) is preferably thrown on and off periodically by a pneumatic actuator (39).

6 Claims, 5 Drawing Figures

ARRANGEMENT ON MULTI-COLOR ROTARY PRESSES FOR APPLICATION OF LIQUIDS TO A PRINTING UNIT CYLINDER

RELATED APPLICATIONS

The present application is a continuation-in-part of U.S. application Ser. No. 500,778 filed June 3, 1983, now abandoned.

TECHNICAL FIELD

The present application relates to rotary printing machines and a roller system that is convertible to apply either dampening solution or varnish to a printed sheet.

BACKGROUND OF THE INVENTION

The invention relates to an arrangement on multicolour rotary printing presses for application of liquid to a printing unit cylinder, wherein the liquid is successively transferred from a liquid tank to a fountain roller driven by a separate drive, the fountain roller engaging a transfer roller in turn feeding an applicator roller engaging a plate cylinder driven by the press drive, and wherein means are provided for throwing on and off the applicator and fountain roller.

It is well known that in offset printing the fresh ink on a printed sheet must be prevented from smearing. Diverse methods, such as heaters or powder, are known for this purpose. In all these methods it has been found that the ink gloss is also affected. To retain the original gloss, varnishes are now used and a further system on the printing press is required to apply the varnish. West German patent 2,020,584 describes a device which transfers a suitable varnish to the printing plate by the dampening unit of the offset press and via a rubber blanket to the printing carrier.

But when the dampening unit is used as a varnishing unit it is difficult to use a varnish having an arbitrary viscosity, because the varnish takes a defined path through the dampening unit and the evaporation of the varnish solvent is fixed by the defined path. The same varnishes, however, cannot always be used for the most diverse sheets or impressions encountered in the printing industry. In the known types of dampening units the fountain and metering rollers of a dampening unit are driven by an auxiliary motor, and the successive transfer and applicator rollers are driven by the press drive.

SUMMARY OF THE INVENTION

The primary object of the invention is to provide a dampening unit which is convertible to a varnishing unit for applying varnishes having different viscosities.

Another object of the invention is to provide a dampening unit that can function as a varnishing unit which does not require burdensome cleaning and excessive start-up waste or maintenance in the event of printing stoppages.

In accordance with the present invention, a separate drive is provided with additional transmission components for driving a transfer roller and the applicator roller when the press drive is stopped. Driving of the transfer roller or distributor prevents the applicator roller and transfer roller from stopping while the printing machine is stationary, and thereby prevents drying of the varnish during printing stoppages. When the dampening unit is used as a varnishing unit only, the fountain and metering rollers are driven via the separate drive, so that varnish starts to dry on the applicator and transfer rollers in a controlled fashion.

In accordance with another aspect of the invention, the facilities for throwing the rollers on and off are provided with a swiveling stop for providing that all rollers remain in contact or alternatively are separate from each other, when the applicator roller is thrown off.

Thus the additional transmission components and the swiveling stop allow the dampening unit to be used as a varnishing unit if required. In addition, the fountain roller preferably is thrown-on and off at intervals when the plate cylinder impression is thrown-on or off. This operation of the fountain roller permits accurately metered application of the varnish to the rollers in a particularly advantageous way.

The swiveling stop permits three positions or orientations of the rollers with respect to each other. In the first position the applicator roller engages both the transfer roller and the plate cylinder. This first position is used during continuous printing when the dampening unit is used for dampening and also when the dampening unit is converted and used as a varnishing unit.

In the second position the applicator roller is separated from the plate cylinder but is still engaged with the transfer roller. This second position is used during a stoppage of the printing press, or when the unit is converted and used as a varnishing unit.

In the third position the applicator roller is thrown-off from the plate cylinder and thrown-off by about 5/10 mm from the transfer roller. This third position is used during interruptions or stoppages in printing when the unit is used as a dampening unit.

As noted above, the fountain roller is preferably thrown-on and off at intervals when the unit is converted and used as a varnishing unit. In addition to the above-mentioned accurate metering of the rollers, the varnish is mixed in the fountain and cannot dry on the rollers due to their rotation.

Preferably, the varnish supply is adjusted via the separate drive, as noted above, so that the varnish coating on the plate cylinder reaches the blanket cylinder about 1 to 2 revolutions before the paper is printed.

During normal operation the fountain roller and applicator roller are thrown on to the transfer roller coincident with the throw-on of printing impression. For varnishing work the fountain roller and applicator roller are subsequently thrown-on to the transfer roller to prevent the above-mentioned excess supply of varnish for the first sheets on 4- and 6-colour machines due to incipient drying or spraying. When printing impression is thrown-off the fountain and applicator rollers are thrown-off automatically after the final sheet has passed through.

BRIEF DESCRIPTION OF THE DRAWINGS

Further objects and advantages of the invention will become apparent upon reading the following detailed description and upon reference to the drawings in which.

Figure 1:
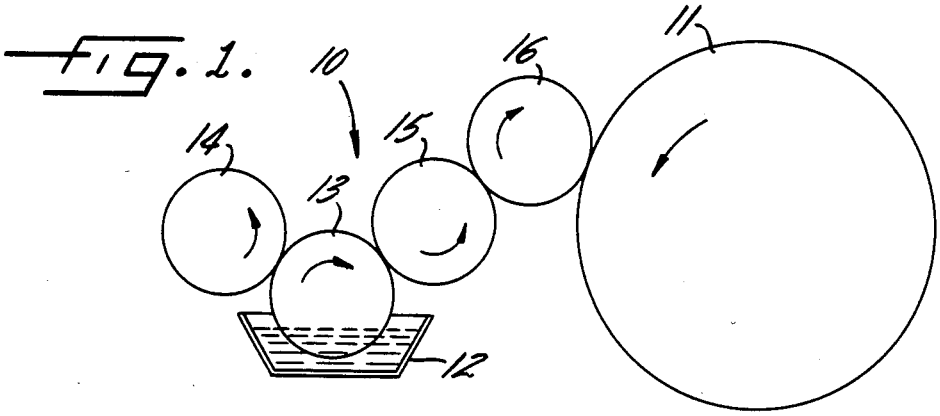
FIG. 1 shows a side view of the rollers in a dampening unit.

While the invention is susceptible to various modifications and alternative forms, a specific embodiment thereof has been shown by way example in the drawings, and will herein be described in detail. It should be understood, however, that it is not intended to limit the invention to the particular form disclosed, but, on the contrary, the intention is to cover all modifications, equivalents, and alternatives falling within the spirit and scope of the invention as defined by the appended claims.

DESCRIPTION OF A PREFERRED EMBODIMENT

Turning now to the drawings, there is shown in FIG. 1 a very general schematic diagram of a dampening unit 10 cooperating with a plate cylinder 11. In order to convey dampening medium from a liquid tank or fountain 12 to the cylinder 11, a fountain roller 13 is journaled for rotation within the fountain 12 to pick up a film of dampening solution. To regulate the amount of ink film on the fountain roller 13, a metering roller 14 engages the fountain roller 13. The metered dampening solution on the fountain roller 13 is conveyed to a transfer roller 15 which in turn conveys the solution to an applicator roller 16. The applicator roller 16 engages the plate cylinder 11 and thereby transfers the film of dampening solution to the plate cylinder 11.

Figure 2:
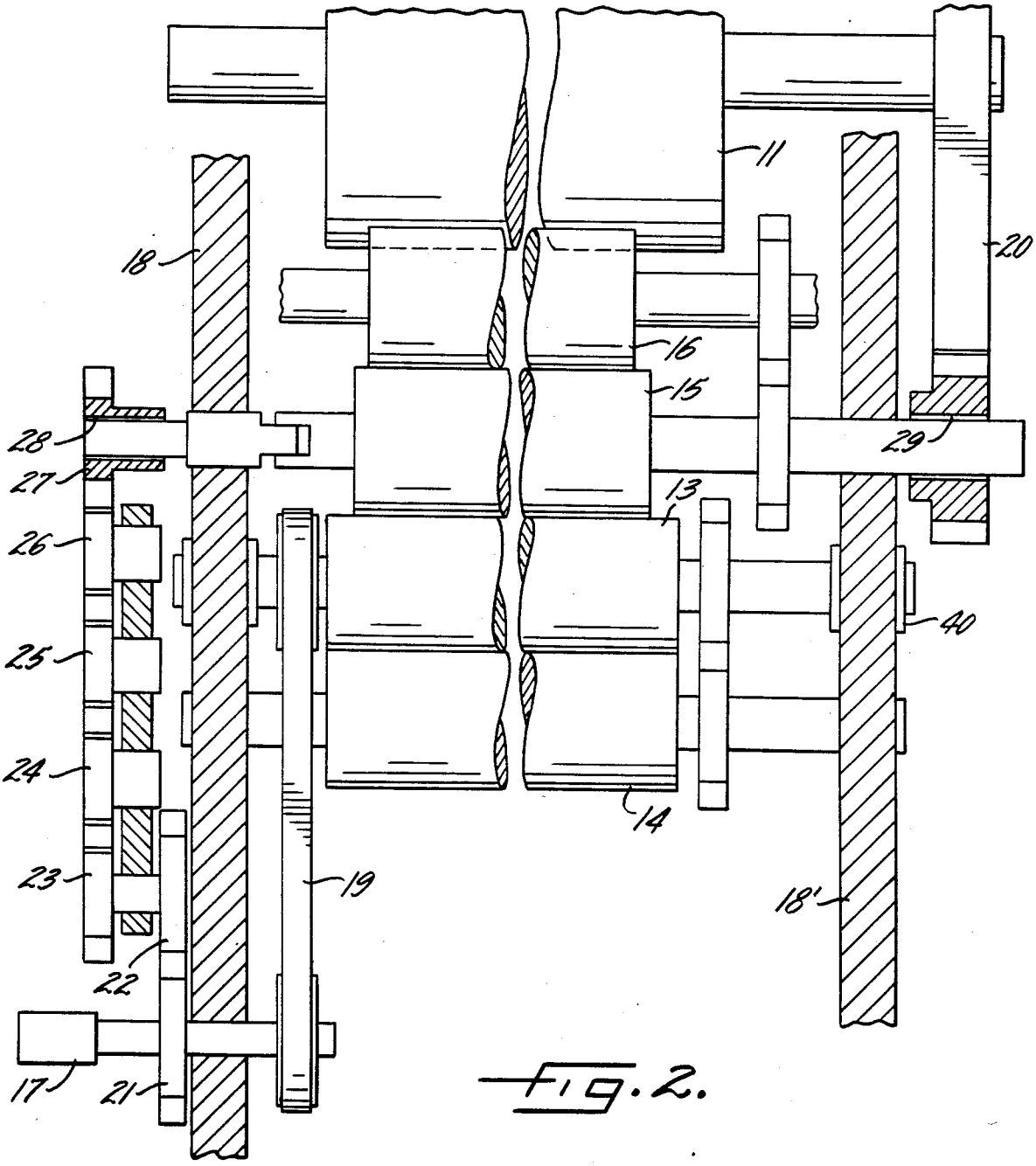
FIG. 2 is a plan view of the rollers and drives in a convertible dampening unit according to the invention.

Turning to FIG. 2 there is shown a separate drive 17 on the side holders or frames 18, 18' of the printing machine which is not represented in further detail. The separate drive 17 is provided to rotate the fountain roller 13 in the already known way via a belt drive 19.

A conventional machine drive 20 is provided for rotating the plate cylinder 11. During dampening and continuous printing, the transfer roller 15 is driven in synchronism with the plate cylinder 11 by the drive 20 in the usual fashion.

In accordance with an important aspect of the invention, transmission components including gear wheels 21, 22, 23, 24, 25, 26 and 27 are mounted to the side frame 18 to drive the transfer roller 15 by the separate drive 17. Respective idling facilities or clutches 28, 29 are provided to selectively connect the transfer roller 15 to either the fountain roller drive 17 or the printing machine drive 20. During dampening and continuous printing the clutch 28 is disengaged and the clutch 29 is engaged so that the transfer roller 15 is driven in synchronism with the plate cylinder 11 by the printing press drive 20. When the applicator roller 16 is thrown-off from the transfer roller 15 (as shown in FIG. 5 and described below) the clutch or idling facility 29 is disengaged and the clutch or idling facility 28 is engaged so that the transfer roller 15 is driven at a slower speed by the drive 17 via the transmission components 21–27.

Figure 3:
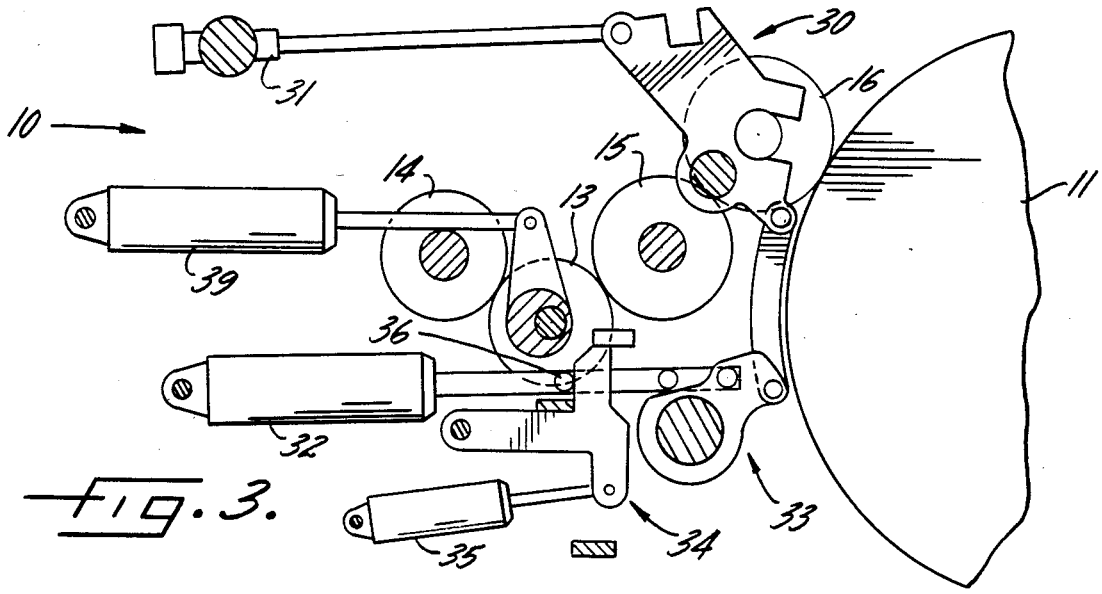
FIG. 3 shows a side view of the rollers and swiveling stop in the dampening unit converted and operating as a varnishing unit with impression on, FIG. 4 shows a similar side view of the dampening unit converted to a varnishing unit, when thrown-off and for a first stop position, the fountain roller being thrown-on and off at intervals.
Figure 4:
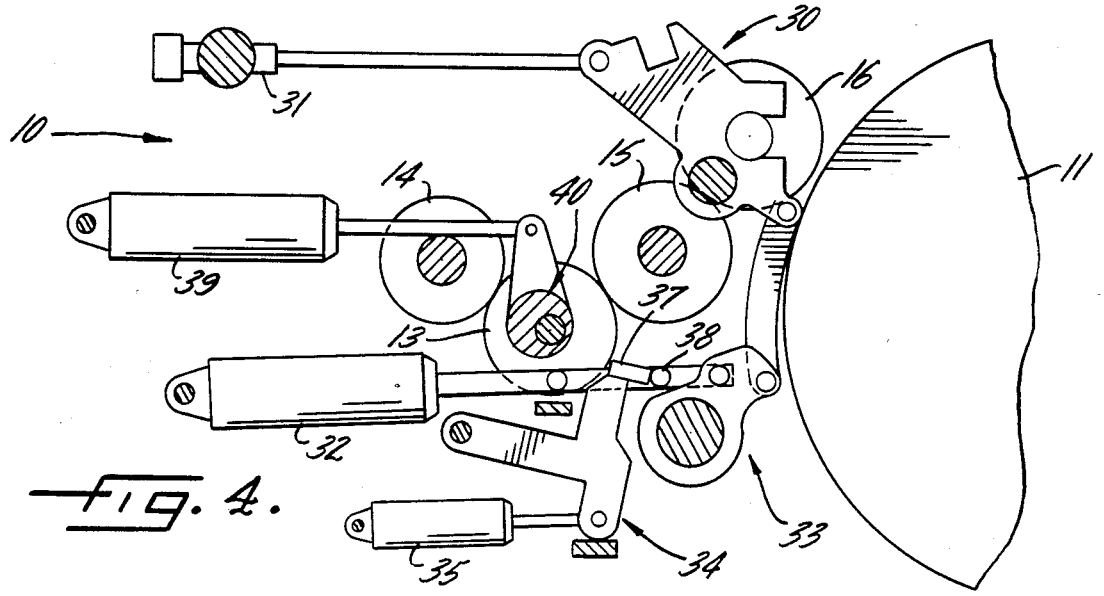

Turning now to FIG. 3 there is shown a side view of the rollers and swiveling stop in the dampening unit 10 operating as either a dampening unit or a varnishing unit with impression on. In this "impression on" position the fountain roller 13 engages the metering roller 14 and the transfer roller 15. Moreover, the applicator roller 16 engages the plate cylinder 11 and the transfer roller 15. It should be noted that the applicator roller 16 is journaled to a swiveling mechanism generally designated 30 including an impression adjusting stop 31 and an impression throw-off pneumatic actuator 32 connected to the applicator cylinder 16 through a linkage generally designated 33. The swiveling mechanism 30 pivotally mounts the journal of the applicator roller 16 to the side frames 18, 18' (FIG. 2) of the printing machine so that when the applicator roller 16 pivots away from the cylinder 11 it first disengages the plate cylinder 11 and later disengages the transfer roller 15. The cross-hatched components in FIG. 3 as well as FIGS. 4–5 are fixed or, in the case of the roller journals, journaled to the side frame 18' in FIG. 2. A second set of similar components as shown in FIG. 3 are mounted to the side frame 18 so as to support the other end portions of the rollers.

Figure 5:
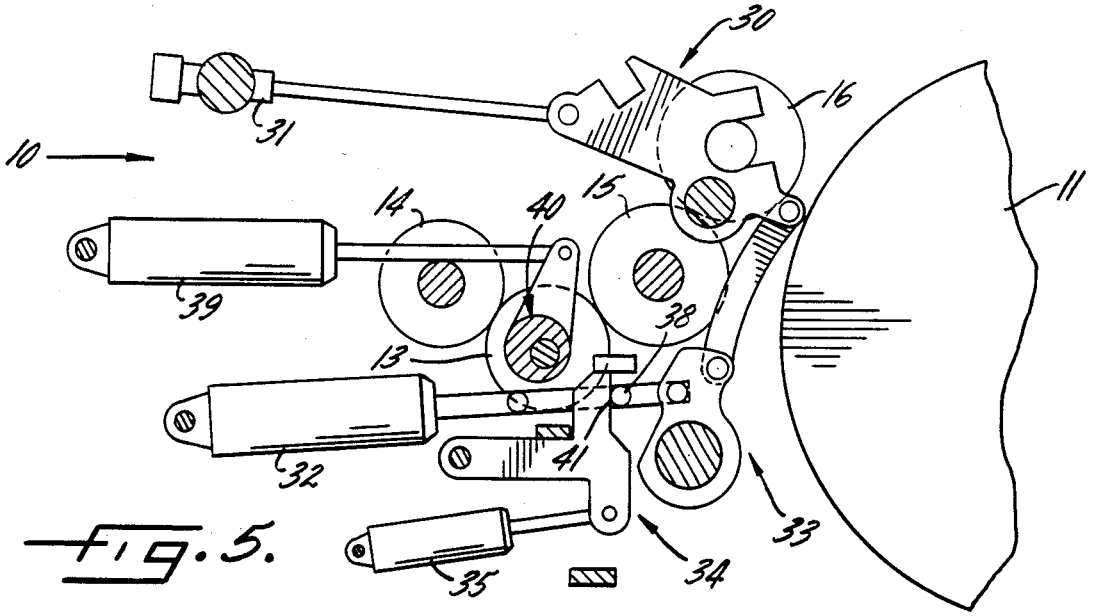
FIG. 5 shows a similar side view of the dampening unit set for dampening and when thrown off and for a second stop position, the applicator roller being withdrawn about 5/10 mm from the transfer roller.

In accordance with an important aspect of the invention, a swiveling stop generally designated 34 defines two impression throw-off positions shown in FIG. 4 and FIG. 5, respectively, thereby permitting the dampening unit generally designated 10 to double as a varnishing unit. When the pneumatic cylinder 32 is activated for throw-off of the applicator roller 16 from the plate cylinder 11, the dampening unit 10 functions either as a varnishing unit as shown in FIG. 4 or a dampening unit as shown in FIG. 5 in response to whether the swiveling stop 34 is in a downward position as shown in FIG. 4 or an upward position as shown in FIG. 5. The swiveling stop 34 is set in either a downward or upward position by a pneumatic actuator 35. When impression is on, the swiveling stop 34 is in the upward position and engages a pin 36 on the piston of the actuator 32. When the swiveling stop is in the downward position, the throw-off of the applicator roller 16 from the plate cylinder 11 is set by an adjustable stop 37 mounted to the swiveling stop 34 engaging a pin 38 on the piston of the actuator 32.

In the varnishing position as shown in FIG. 4, the fountain roller 13 is periodically thrown-on and off by activation of a third pneumatic actuator 39 in order to prevent the varnish from drying on the rollers 14, 15, and 16. For this purpose, the fountain roller 13 is mounted to the side frames 18, 18' (FIG. 1) of the printing machine via eccentric mounts, such as the mount generally designated 40, pivoted by the pneumatic actuator 39. Thus, the need to wash or rinse the rollers 14, 15, and 16 after stoppage of printing is eliminated by throwing the fountain roller 13 on and off at intervals by the pneumatic actuator 39.

FIG. 5 shows the second stop position wherein the applicator roller 16 is withdrawn about 5/10 mm from the transfer roller 15. In this case, the pin 38 secured to the piston of the pneumatic actuator 32 engages with a lower stop surface 41 on the swiveling stop 34. As noted above, this third position of the applicator roller is used during interruptions or stoppages in printing when the unit 10 is used as a dampening unit.

In view of the above, a convertible dampening unit has been described which applies varnishes having different viscosities but which does not require burdensome cleaning and excessive start-up waste or maintenance in the event of printing stoppages.

What is claimed is:

1. In a printing unit in a multi-color rotary printing press, a device for applying liquids to a cylinder in the printing unit driven by a press drive, said device being selectively convertible to function either as a dampening unit or as a varnishing unit, said device comprising a series of rollers mounted to side frames of the printing unit including a fountain roller for receiving liquid from a liquid tank, a transfer roller for receiving liquid from the fountain roller, and an applicator roller for receiving liquid from the transfer roller and applying liquid to said cylinder, the transfer roller being journaled to the side frames, the applicator roller being mounted to the side frames via a first swiveling mount having means defining three positions of the applicator roller, said three positions including a first position wherein the transfer roller is engaged with the applicator roller and the applicator roller is engaged with the cylinder, a second position wherein the transfer roller is engaged with the applicator roller but the applicator roller is disengaged from the cylinder, and a third position wherein the transfer roller is disengaged from the applicator roller and the applicator roller is disengaged from the cylinder, said means defining the three positions including first and second adjustable stops for setting the respective first and second positions, a first pneumatic actuator for disengaging and engaging the applicator roller, and a second pneumatic actuator for engaging and disengaging the second stop so that said first pneumatic actuator selects the second position of the applicator roller when the second stop is engaged and the third position of the applicator roller when the second stop is disengaged, a second swiveling mount for mounting the fountain roller to the side frames, and a third pneumatic actuator for swiveling the second swiveling mount to selectively throw the fountain roller on and off of the transfer roller and means for selectively driving the transfer and applicator rollers either via the press drive or by a separate drive, so that said device for applying liquids may function as a dampening unit with the applicator and transfer rollers driven by the press drive and the applicator roller being thrown-off to the third position during printing interruptions, or as a varnishing unit with the applicator and transfer rollers being driven by the separate drive and the applicator roller being thrown-off to the second position and the fountain roller being thrown-on and off during printing interruptions.

2. The device for applying liquids as claimed in claim 1, wherein said first swiveling mount includes an eccentric mount, said fountain roller is driven by said separate drive, and further comprising a metering roller journaled to the side frames and engaging said fountain roller when said fountain roller is engaging said transfer roller.

3. In a printing unit in a multi-color rotary printing press, a device for applying liquids to a cylinder in the printing unit driven by a press drive, said device being selectively convertible to function either as a dampening unit or as a varnishing unit, said device comprising a series of rollers including a fountain roller for receiving liquid from a liquid tank, a transfer roller for receiving liquid from the fountain roller, and an applicator roller for receiving liquid from the transfer roller and applying liquid to said cylinder, means for mounting the rollers to side frames of the printing unit, said means for mounting including means defining three relative positions of the applicator roller with respect to the transfer roller and the cylinder, said three relative positions including a first position wherein the transfer roller is engaged with the applicator roller and the applicator roller is engaged with the cylinder, a second position wherein the transfer roller is engaged with the applicator roller but the applicator roller is disengaged from the cylinder, and a third position wherein the transfer roller is disengaged from the applicator roller and the applicator roller is disengaged from the cylinder, said means defining the three positions including actuators for selecting a desired one of said three relative positions of the applicator roller, said means for mounting the rollers further including means having an actuator for selectively throwing the fountain roller on and off of the transfer roller, and means for selectively driving the transfer and applicator rollers either via the press drive or by a separate drive, so that said device for applying liquids may function as a dampening unit with the applicator and transfer rollers driven by the press drive and the applicator roller being thrown-off to the third position during printing interruptions, or as a varnishing unit with the applicator and transfer rollers being driven by the separate drive and the applicator roller being thrown-off to the second position and the fountain roller being thrown-on and off during printing interruptions.

4. The device for applying liquids as claimed in claim 3, wherein said fountain roller is driven by said separate drive, and further comprising a metering roller journaled to the side frames and engaging said fountain roller when said fountain roller is engaging said transfer roller.

5. In a printing unit in a multi-color rotary printing press, a device for applying liquids to a cylinder in the printing unit driven by a press drive, said device being selectively convertible to function either as a dampening unit or as a varnishing unit, said device comprising a series of rollers mounted to side frames of the printing unit including a fountain roller for receiving liquid from a liquid tank, a transfer roller for receiving liquid from the fountain roller, and an applicator roller for receiving liquid from the transfer roller and applying liquid to said cylinder, the transfer roller being journaled to the side frames, the applicator roller being mounted to the side frames via a first swiveling mount having means defining three positions of the applicator roller, said three positions including a first position wherein the transfer roller is engaged with the applicator roller and the applicator roller is engaged with the cylinder, a second position wherein the transfer roller is engaged with the applicator roller but the applicator roller is disengaged from the cylinder, and a third position wherein the transfer roller is disengaged from the applicator roller and the application roller is disengaged from the cylinder, said means defining the three positions including first and second adjustable stops for setting the respective first and second positions, and first and second pneumatic actuators for selecting a desired one of said three positions, a second swiveling mount for mounting the fountain roller to the side frames, and a third pneumatic actuator for swiveling the second swiveling mount to selectively throw the fountain roller on and off of the transfer roller, and means for selectively driving the transfer and applicator rollers either via the press drive or by a separate drive, so that said device for applying liquids may function as a dampening unit with the applicator and transfer rollers driven by the press drive and the applicator roller being thrown-off to the third position during printing interruptions, or as a varnishing unit with the applicator and transfer rollers being driven by the separate drive and the applicator roller being thrown-off to the second position and the fountain roller being thrown-on and off during printing interruptions.

6. The device for applying liquids as claimed in claim 5, wherein said first swiveling mount includes an eccentric mount, said fountain roller is driven by said separate drive, and further comprising a metering roller journaled to the side frames and engaging said fountain roller when said fountain roller is engaging said transfer roller.

* * * * *